United States Patent [19]

Platt

[11] 4,142,652

[45] Mar. 6, 1979

[54] AEROSOL METERING

[75] Inventor: Norman E. Platt, Randolph, N.J.

[73] Assignee: Warner-Lambert Company, Morris Plains, N.J.

[21] Appl. No.: 830,373

[22] Filed: Sep. 2, 1977

[51] Int. Cl.[2] ..... B65D 83/14

[52] U.S. Cl. ..... 222/189; 222/402.2; 239/590.3

[58] Field of Search ..... 239/590.3; 222/187, 222/189, 402.1, 402.2, 402.24

[56] References Cited

U.S. PATENT DOCUMENTS

| | | | |
|---|---|---|---|
| 2,815,889 | 12/1957 | Stetz et al. | 222/189 |
| 3,986,212 | 10/1976 | Sauer | 3/1.91 |
| 4,077,542 | 3/1978 | Petterson | 222/402.2 X |

*Primary Examiner*—David A. Scherbel

*Attorney, Agent, or Firm*—Albert H. Graddis; Frank S. Chow

[57] ABSTRACT

The metered discharge of aerosol compositions from aerosol dispenser packs through an ordinary aerosol valve is achieved with precise control over both the amount discharged during each metered discharge operation and the specific time interval available between each metering operation by causing the aerosol composition to traverse a closed path from the body of the aerosol pack to the discharge orifice through a plug fitted into the tailpiece of the valve, the plug comprising a variable length of a reticulated porous polymeric material having an average pore diameter of less than 10 microns with the pore volume being between 10 and 50% of the plug. The plug is fitted to the tailpiece of the valve which enables uniform spray characteristics to be obtained.

3 Claims, 4 Drawing Figures

AEROSOL METERING

The present invention relates to aerosol valves and dispenser packs in a form adapted for the uniform dispensing of aerosol compositions in precisely controlled metered amounts.

The usual aerosol dispenser pack comprises a closed system consisting of a container in which the material to be dispensed is maintained under the pressure of a suitable propellant and provided with a discharge valve having a tailpiece, a valve actuator, and a dip tube connecting the contents of the aerosol pack to the tailpiece of the discharge valve.

To dispense the aerosol composition from the aerosol pack, the actuator button of the valve mechanism is depressed, and with the valve open, the pressure of the propellant forces the composition up through the dip tube, the valve and the valve actuator from which it is discharged through an orifice to the atmosphere. Since the contents of the aerosol pack are under the vapor pressure of the propellant in the closed system, the contents will continue to be discharged from the container as long as the valve actuator is in depressed position.

The propellant or combination of propellants employed are so chosen that the internal vapor pressure generated is sufficiently high at the normal temperature of use to cause the contents of the aerosol pack to be discharged upon operation of the actuator button of the valve mechanism. Depending upon the manner in which the aerosol composition is formulated, the contents of the aerosol pack can be discharged through the valve orifice as a spray, a foam, or as a thin, jet-like stream. The particular formulation chosen will depend upon the desired application of the composition and the form in which the product is desired to be discharged. The physical characteristics of the product discharged may also be a function of the type of valve and of the propellant system employed. Some compositions, such as perfumes, for example, are preferably dispensed intermittently in a controlled manner. When so discharged each time the valve is actuated, a single measured burst of the perfume composition will be discharged from the valve orifice.

Many well-accepted valve configurations which are designed to permit the continuous discharge of aerosol compositions from a container when the valve mechanism is maintained in actuated position having long been widely available to the aerosol industry. These valves are and have been manufactured and used in very substantial quantities. Due to their relatively simple design and to the vast quantities in which they are manufactured, these valves are available at very competitive prices.

Aerosol valves which are capable of producing a metered discharge are somewhat more complex in structure. While they too are widely available at competitive prices, the cost of these metering valves is approximately 30% to 300% higher than the cost of the simpler, continuous-discharge aerosol valves. One factor contributing to the higher cost of metering valves compared to continuous discharge valves is the more involved tooling necessary for producing a line of metering valves, the increased number of parts required and the necessity for offering a series of metering valves of different discharge capacities to the trade. In addition, it may also be desirable in some applications where, for example, an aerosol dosage form of a pharmaceutical composition is employed, to maintain some degree of control over the time interval or frequency of application so that excessive use is avoided. To incorporate an automatic external time control or time lag into the operation of the metering valve adds still further to the cost.

It has been proposed, for example, by Stetz, et al., in U.S. Pat. No. 2,815,889 that metered control of the discharge of aerosol compositions from aerosol containers can be achieved by placing a porous ceramic or fibrous material, such as felt, in the feeder or dip tube leading to the valve mechanism from the bottom of the aerosol container. The use of such a porous plug located in the tube is said to allow liquid flow only at a restricted rate. With the plug in position, liquid gradually flows into and accumulates in the chamber or space located between the plug and the valve. When the valve is opened, it is only this accumulated liquid which will then be discharged. After a certain time interval, depending on the flow rate through the porous plug, additional liquid again accumulates in the chamber or space between the plug and the valve. Upon actuating the valve, just the amount of liquid in the space is discharged and by repeating this sequence, the desired metering effect is achieved.

The method or structure suggested by Stetz, et al., does not appear to have been adopted by the industry, and certainly does not seem to have been commercially successful. The principal reason is that the Stetz, et al., patent does not contain any disclosure of an operative embodiment of a metering valve structure. The mention of the use of a plug of fibrous material, such as felt, or of a porous ceramic in the dip tube is not a teaching of how to practice the alleged invention, since neither material is really practical, and the location of either in the dip tube itself does not yield an aerosol product of any practical commercial application since, at best, only a sputtering and uneven discharge is obtained.

It is, therefore, an important object of this invention to provide a novel aerosol valve structure which is modified to include a shaped, reticulated porous polymer in the valve tailpiece so as to be adapted to be used for the metered discharge of various aerosol compositions.

Another object of this invention is to provide new and novel aerosol valve structures modified to include integral means in the form of a shaped, porous polymer having precise physical characteristics for achieving a controlled metered discharge and a predetermined time delay between operations in discharging aerosol compositions.

A further object of this invention is to modify the tailpiece of a conventional non-metering valve to enable it to be converted into a metering valve with controlled but variable time delay, while retaining all other desirable characteristics of such non-metering valves.

Other objects of this invention will appear from the following detailed description and the accompanying drawings.

In the drawings.

Like reference numerals indicate like parts throughout the several views of the drawings.

Figure 1:
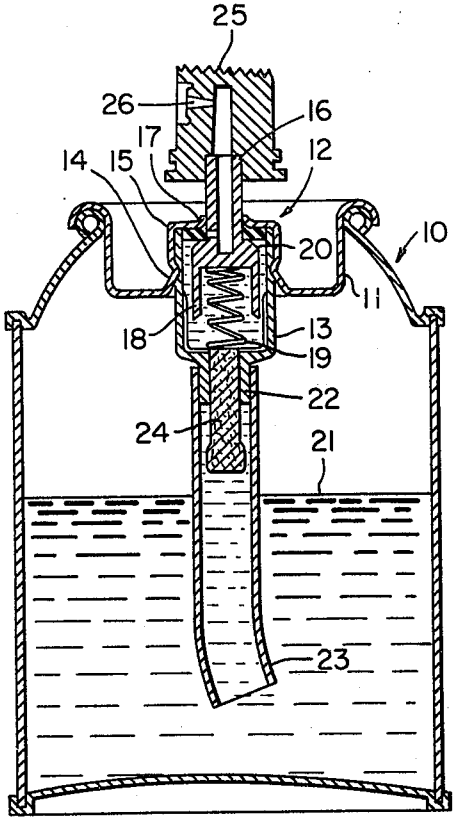
FIG. 1 is a side-elevational view, in section, of a pressurized aerosol container or dispenser pack provided with a widely-employed, commercially available aerosol discharge valve which is shown in closed position and is connected to the contents of the container by a dip tube and whose tailpiece is modified in accordance with the present invention to produce a metering effect.

Referring now to the drawing, and more particularly, to FIG. 1, the usual form of aerosol pack comprises a container generally indicated by reference numeral 10 to which a cup 11 is crimp-sealed and which contains an integrally mounted valve mechanism generally indicated by reference numeral 12. Valve mechanism 12 comprises a valve housing 13 held in fixed position in relation to cup 11 by action of crimp seal 14 which holds the upper annular edge of housing 13 firmly in sealed position against gasket 15. Reciprocally mounted within valve housing 13 is the inner operating valve mechanism itself, the upper portion of which consists of a valve stem 16, provided with a discharge orifice 17, while the lower portion, integrally molded with stem 16, forms an inverted cup 18. The valve mechanism is normally biased to closed position by the expansion of a helical spring 19 the pressure of which causes the outer shoulder 20 at the base of valve stem 16 to seat against the valve seat formed by sealing gasket 15. The composition which forms the contents 21 of the aerosol pack is a liquid and is present in admixture with a suitable propellant. In the most common commercially available products, the propellant is at least partially soluble in the liquid composition being discharged. The vapors of the propellant normally occupy the head space between the surface of composition 21 and inner surface of the valve cup 11 so that the vapor pressure of the propellant will maintain the composition under pressure. The base of valve housing 13 terminates in a tailpiece 22. The liquid contents 21 of the aerosol pack are normally carried up into valve mechanism 12 and valve housing 13 by means of a dip tube 23 which is attached to tailpiece 22 at one end, the other end being immersed in liquid contents 21 of the aerosol pack and being long enough to terminate just short of the base of container 10.

In accordance with the present invention, however, as shown in detail in FIG. 1, the tailpiece of the discharge valve described is modified to achieve an accurate and carefully controlled metering action. This desirable result is achieved by interposing a particular shaped, reticulated porous polymer plug 24 into the normally free path of the contents 21 of the aerosol composition as it passes through dip tube 23 into the valve housing 13. As hereinafter described in detail, the physical structure, characteristics, and composition of the porous polymer plug 24 and its permissible flow rate are critical if the desired controlled metering effect is to be achieved.

Figure 3:
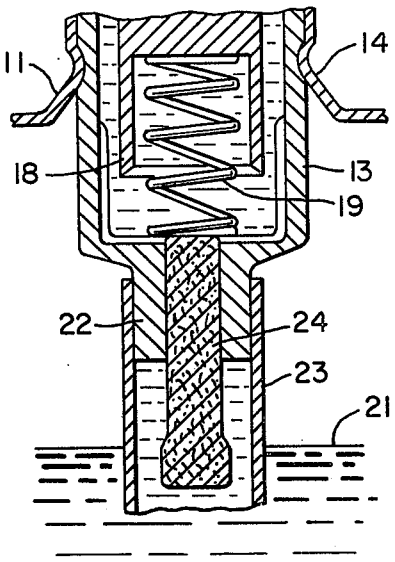
FIG. 3 is a view, in section and on an enlarged scale, of the valve mechanism shown in FIG. 2.
Figure 2:
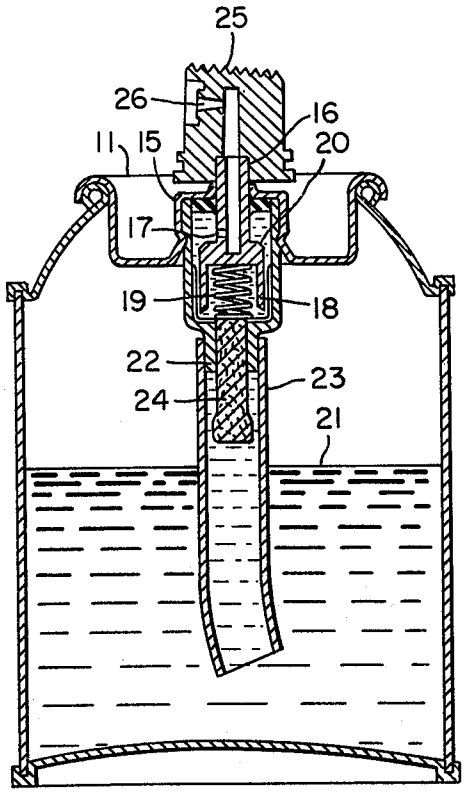
FIG. 2 is a side-elevational view, in section, of the same dispenser pack employing the same commonly available and widely-employed aerosol discharge valve modified in accordance with the present invention and shown now in open or discharging position.

The normal operation of the valve mechanism 12 is effected by exerting downward pressure on the valve stem 16 by means of an actuator button 25 seated on valve stem 16. This downward movement against the pressure of spring 19, as shown in FIG. 2, unseats the outer shoulder 20 of inverted cup 18 and further movement causes discharge orifice 17 to move downward to a position where it clears the lower edge of gasket 15. Thus, the path from the container through the dip tube 23, plug 24, valve housing 13, valve discharge orifice 17, valve stem 16 and out through discharge orifice 26 in actuator button 25 is open.

However, by placing a plug 24 of suitable physical characteristics in the tailpiece 22 of valve housing 13, both the path and rate of flow of the liquid contents 21 from the inside of container 10 up through dip tube 23 and into valve housing 13 will be restricted. Upon the operation of the valve mechanism 12, since the free flow of the liquid contents is altered, only the limited volume contained within the portion of valve housing 13 surrounding helical spring 19 is immediately available to pass through valve stem orifice 17 and for discharge through orifice 26 to the atmosphere. While the vapor pressure of the propellant will still force the liquid contents 21 up into dip tube 23 and maintain a reservoir of liquid within dip tube 23 the plug 24 sufficiently restricts flow through the available passages to prevent immediate passage of any additional liquid from dip tube 23 into valve housing 13. Thus, when the valve mechanism 12 is operated, only a metered quantity is effectively discharged. With plug 24 being formed of a suitable structure, the rate of flow into valve housing 13 can be precisely controlled. Thus, not only can valve mechanism 12 be converted easily into a metering valve by placing plug 24 in tailpiece 22, any desired time delay between each discharge can be built into the mechanism by altering the pore dimensions and length in the tailpiece plug 24.

The porous plug employed is preferably formed of porous high density polyethylene, polypropylene, polybutylene or mixtures thereof, the structure of which is formed to include an internal network of interconnected pores, characterized by the fact that in the internal network of pores there are, generally, no straight paths longer than the diameter of the largest pore. This physical property is characterized by the term "tortuosity" and the materials forming an essential element of the valve structures of this invention are distinguished by such physical structure.

To function properly and control the flow rate of the aerosol composition when placed in the valve tailpiece in the form of a plug, the polymeric material should have (a) a density of approximately 0.912–0.914 g/cc for polypropylene and 0.945–0.965 g/cc for high density polyethylene, (b) a molecular weight of from 200,000 to over 6,000,000, (c) an average pore diameter of less than 10 micrometers and (d) an average pore volume of between 10 and 50% of the plug. Variation of the average pore diameter and average pore volume enables the refill time of the valve chamber to be adjusted as desired. The polymeric materials useful are further described in U.S. Pat. No. 3,986,212.

It has also been found that impregnation of the porous plastic with a polymeric resin such as an epoxy may be useful to increase the stiffness of the part for improved mechanical handling, while modifying the pore structure.

The location of the porous plug has a marked effect in obtaining satisfactory performance and upon the spray pattern produced by the metered aerosol composition. By locating the porous plug in the tailpiece of the valve, the beginning and end of the unit of material discharged as the metered spray are sharply defined. Location of the porous plug at a point somewhere along the length of the dip tube produces an erratic and sputtery and poorly defined discharge pattern which is quite unacceptable.

This invention is readily applied to various types of available aerosol valves including, not only the vertical action valve described, but also those which operate by tilt or toggle action. By the application of the metering plug to a low force standard valve, a very effective and reliable metering action can be obtained with a valve operating force which is only 25 to 50% of the force normally required to operate ordinary metering valves.

By reason of the specific structure of the porous materials employed, the aerosol product is automatically filtered clear of any foreign particles, which can be a potential source of valve problems. This filtering action is enhanced and clogging avoided by exposure of a greater length of the porous material into the dip tube.

The capacity of the metering chamber may be adjusted by the degree of protrusion of the porous plug through the tailpiece and into the valve housing and can be reduced by placing the plug further into the body.

In order further to illustrate this invention, the following example is given:

EXAMPLE 1

An aerosol air freshener composition is given below for use in a battery operated machine, such as the Schick "Fresh Air Machine", which automatically depresses the valve actuator at preset intervals. The duration of the valve depression may be controlled within the broad range of 0.4 seconds to 2.0 seconds, but at each operation the valve delivers 0.050 grams.

| Aerosol Composition | |
|---|---|
| Anhydrous Alcohol | 37.9% - 38.6% w/w |
| Perfume | 1.4% - 2.1% w/w |
| Propellent blend A-46 | 60.0% |
| A-46 | Mol % |
| Propane | 20 |
| N-Butane | 2 |
| Isobutane | 78 |
| | 100 % |

Valve Description

Figure 4:
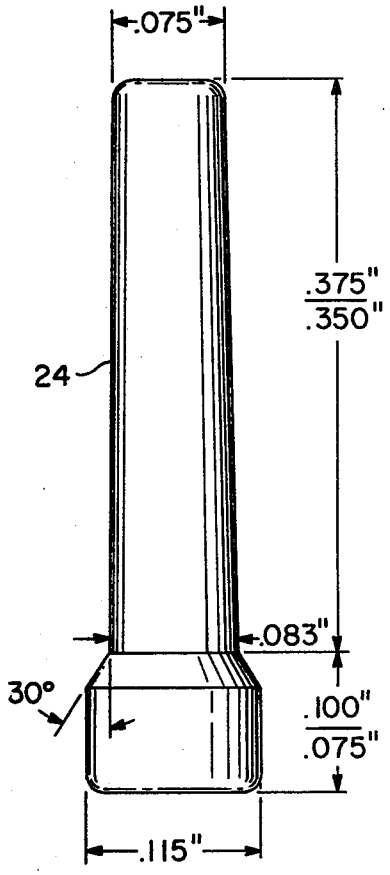
FIG. 4 is an enlarged view of a reticulated porous polymer plug of preferred shape and dimensions employed in accordance with this invention.

The valve employed is an Emson Research, Inc., model #S-32T, with a 0.018" stem orifice. The tailpiece of the valve body is fitted with a porous plug, the dimensions of which are shown in FIG. 4. The porous plug is fabricated of polyethylene of molecular weight 250,000. The average pore diameter of the untreated material is 10 micrometers and the average pore volume of the untreated material is 45%. The untreated, porous, polyethylene plug is then, preferably, impregnated with epoxy resin, which increases the rigidity of the piece. For example, the epoxy resin may be formed in situ by impregnating the plug with a solution of bisphenol A and a substituted amide in a solvent containing a catalyst for the reaction. The average pore diameter of the epoxy impregnated porous polyethylene is reduced to less than 1 micrometer and the average pore volume of the epoxy impregnated porous polyethylene is 20%. The valve is fitted with a standard dip tube and actuator.

With a porous plug having the foregoing physical characteristics placed in the tailpiece, the metering chamber of the valve refills completely every 30–60 seconds. Each actuation of the valve delivers 0.050 grams to 0.060 grams of aerosol product. The force needed to operate this valve is 3.5 lbs., which is the same as the unaltered Emson S-32T valve and is much less than the normal 5 to 7 lbs. required for the usual standard commercial metering valves which are available. The reduced force to operate gives considerable increase in the battery life of the machine.

I claim:

1. A metering valve for intermittently discharging a substantially uniform quantity of an aerosol composition from a container where it is maintained under pressure, comprising, in combination, a valve housing terminating at its lower end in a tailpiece, a valve stem provided with an orifice seated for movement in said housing so that said orifice connects the valve housing with the outside of said container through the valve stem when said valve stem is unseated, a spring normally biasing said valve stem in closed position, and a plug formed of polymeric material porous to said aerosol composition closing the tailpiece of said valve, the material of said plug having a density of at least 0.912 g/cc that includes a network of interconnected pores throughout its volume with no straight paths therein longer than the diameter of the largest pore, the average pore diameter being less than 10 micrometers with the pore volume being from 10 to 50%.

2. A metering valve in accordance with claim 1, wherein the valve stem is mounted in said housing for reciprocating vertical motion.

3. A metering valve in accordance with claim 1, wherein the valve stem is mounted in said housing for movement by tilt action.

* * * * *